US007445515B1

(12) United States Patent
Yuan et al.

(10) Patent No.: US 7,445,515 B1
(45) Date of Patent: Nov. 4, 2008

(54) AUDIO JACK

(75) Inventors: Sheng-tsung Yuan, Tu-Cheng (TW); Yu-hung Su, Tu-Cheng (TW); Chia-tsung Lu, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/905,885

(22) Filed: Oct. 5, 2007

(51) Int. Cl.
*H01R 24/04* (2006.01)

(52) U.S. Cl. ..... 439/668; 439/669

(58) Field of Classification Search ..... 439/668, 439/669

See application file for complete search history.

(56) References Cited

U.S. PATENT DOCUMENTS 7,097,505 B1 * 8/2006 Shanahan et al. ..... 439/607
7,101,230 B2 * 9/2006 Ma ..... 439/668
2005/0048847 A1 * 3/2005 Hsieh ..... 439/668
2006/0141868 A1 * 6/2006 Ma ..... 439/668

* cited by examiner

*Primary Examiner*—Tho D Ta
(74) *Attorney, Agent, or Firm*—Rosenberg, Klein & Lee

(57) ABSTRACT

An audio jack includes an insulating housing having a mating wall, a rear wall, a top wall and two sidewalls. An inserting cavity is defined to pass through the mating wall and extend toward the inner of the insulating housing. The rear wall defines a through-hole communicating with the inserting cavity and the outside. The sidewalls define contact cavities, and a mating contact cavity is defined on the rear wall and communicates with the through-hole. A center pin has a connecting portion received in the inserting cavity. An end of the connecting portion extends to form an engaging portion accommodated in the through-hole. The engaging portion defines a clipping groove surrounding a positioning portion. And contacts include signal contacts inserted in the contact cavities and a mating contact having a secure portion received in the mating contact cavity. The secure portion defines a locating gap engaging with the positioning portion.

4 Claims, 6 Drawing Sheets

AUDIO JACK

BACKGROUND OF THE INVENTION

1. Field of the Invention

The present invention relates to an audio jack, and more particularly to an audio jack mounted in a mobile phone, a notebook computer, a MP3 or the like for electrically connecting with a mating audio connector to transmit audio signals.

2. The Related Art

Along with continual development of various kinds of electronic devices and multimedia technologies, audio connectors which have sound effects are broadly used. The main function of the audio connector is to provide audio signal transmission among electronic devices.

Generally, an audio jack includes an insulating housing defining a hollow receiving cavity passing therethrough. A plurality of terminals is mounted in the insulating housing respectively. Each of the terminals has a contact portion to connect with a mating connector and a mounting portion disposed on a printed circuit board of an electronic device for electrically engaging the audio jack with the electronic device. The audio jack further includes a pin that is fixedly assembled with one terminal. The pin is located in the receiving cavity of the insulating housing. When the mating connector is inserted in the audio jack, the pin is received in the mating connector and electrically connects with the mating connector. Conventionally, a method to assemble the pin with the terminal is to utilize a rivet tool. The pin is riveted together with the terminal via the rivet tool. However, after the rivet tool is repeatedly used for several times, the rivet tool is abraded and needs changing a new one. So a worker has to examine the rivet tool frequently, which squanders work time and manpower. Further more, the pin is easy to become loose after the mating connector is plugged in or drawn out of the audio jack repeatedly, so resulting in a short lifespan of the audio jack and influencing the electrical connection between the mating connector and the audio jack.

SUMMARY OF THE INVENTION

Accordingly, an object of the present invention is to provide an audio jack for electrically connecting with a mating audio connector to transmit audio signals.

To achieve the object, the audio jack includes an insulating housing which has a mating wall, a rear wall opposite to the mating wall, a top wall and two sidewalls. An inserting cavity is defined to pass through the mating wall and extend toward the inner of the insulating housing. The rear wall defines a through-hole passing therethough and communicating with the inserting cavity and the outside. The sidewalls define contact cavities, and a mating contact cavity is defined on the rear wall and communicates with the through-hole. A center pin has a connecting portion received in the inserting cavity. An end of the connecting portion extends to form an engaging portion accommodated in the through-hole. The engaging portion defines a clipping groove therearound. The clipping groove surrounds a positioning portion. And contacts include signal contacts and a mating contact. The signal contacts are inserted in the contact cavities respectively. The mating contact has a secure portion that is received in the mating contact cavity defined on the rear wall of the insulating housing. The secure portion defines a locating gap thereon passing through the bottom thereof. The locating gap engages with the positioning portion of the center pin.

It can be seen from the preceding description that after the center pin is fabricated in the insulating housing, the mating contact is pressed downward. Then the locating gap defined on the secure portion of the mating contact engages with the positioning portion of the center pin. Therefore, the center pin is fixedly assembled with the mating contact without utilizing other tools, simplifying the working procedure, and simultaneously, prolonging the using life of the audio jack and securing the electrical interconnection with the mating audio connector.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
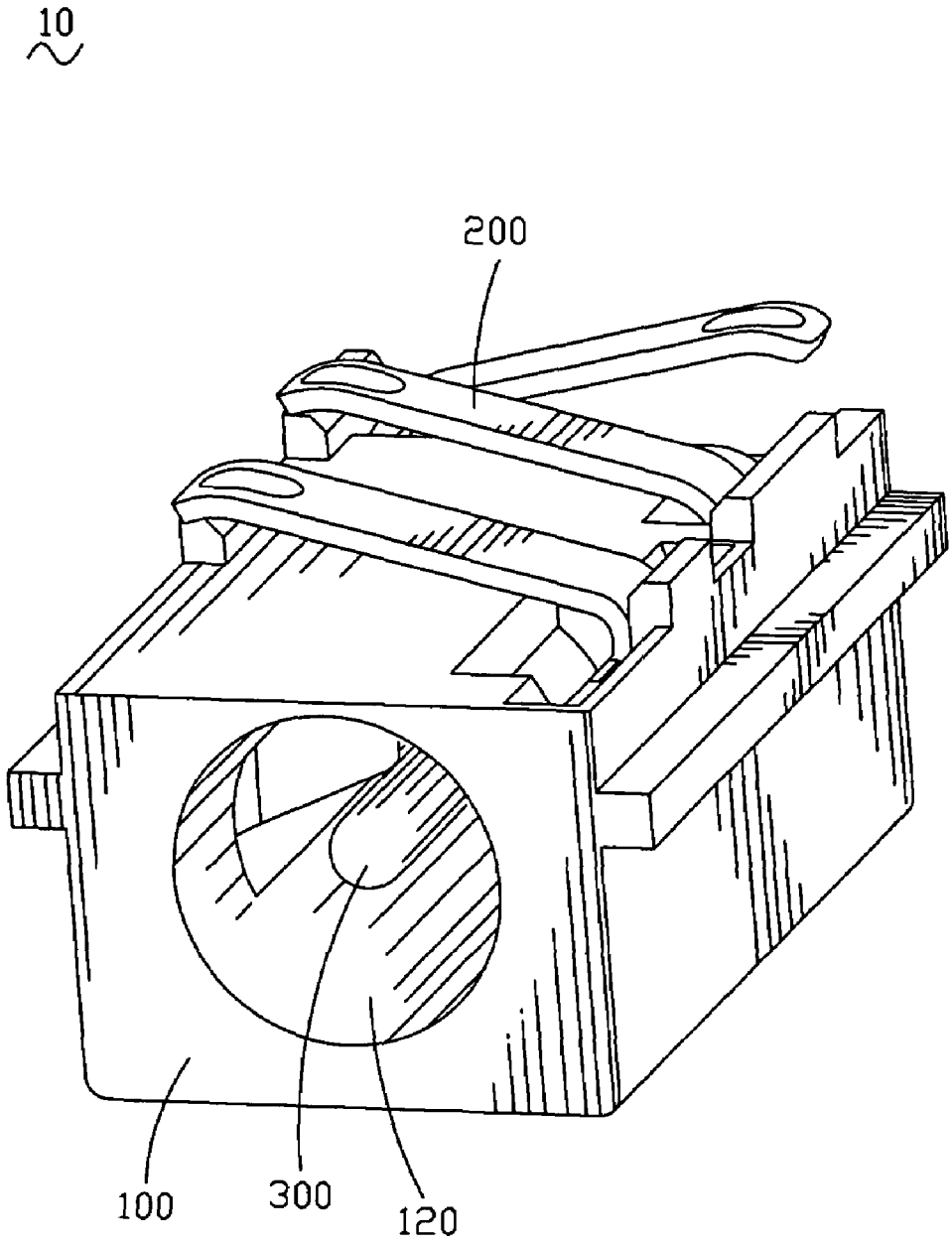
FIG. 1 is a perspective view of an audio jack in accordance with the present invention.

Referring to FIG. 1, an audio jack 10 of the present invention which couples with a mating audio connector to transmit audio signals includes an insulating housing 100, a plurality of contacts 200 inserted in the insulating housing 100 respectively, and a center pin 300 received in the insulating housing 100.

Figure 2:
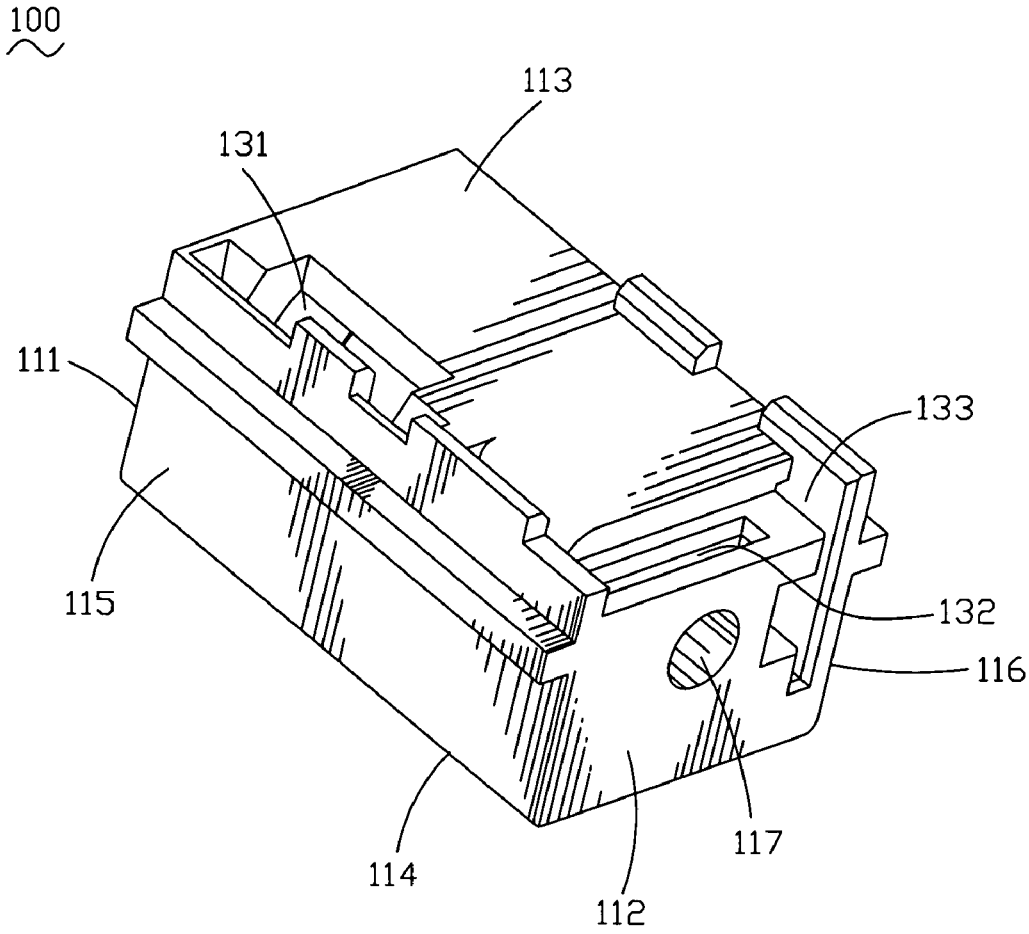
FIG. 2 is a perspective view of an insulating housing of the audio jack.
Figure 5:
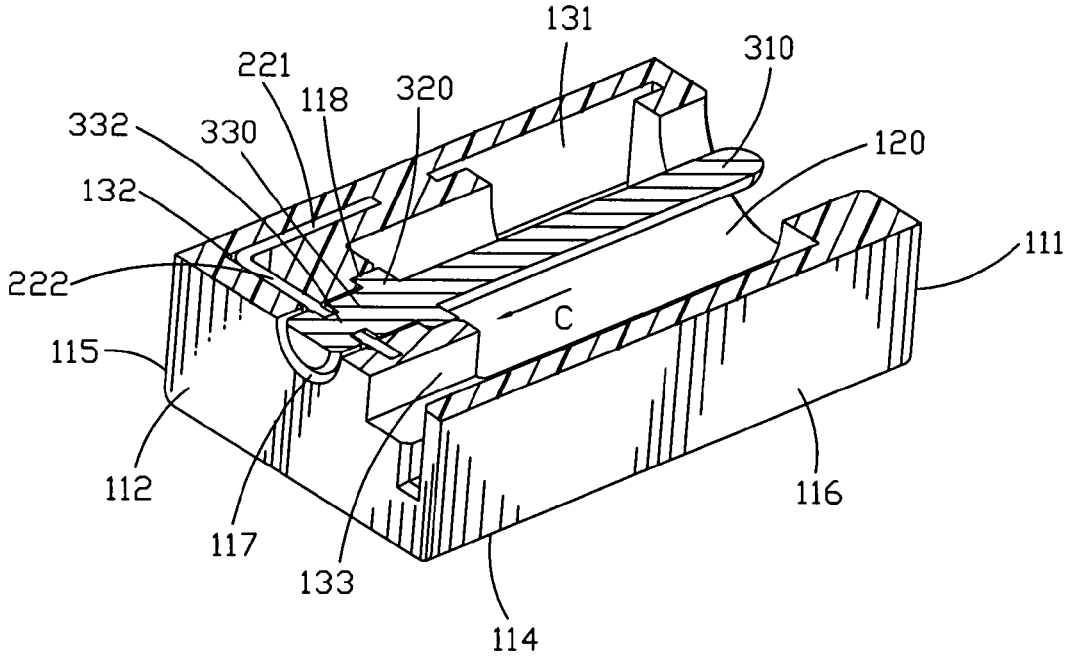
FIG. 5 is a cross-sectional view of the center pin, a mating contact and the insulating housing which are assembled together.
Figure 6:
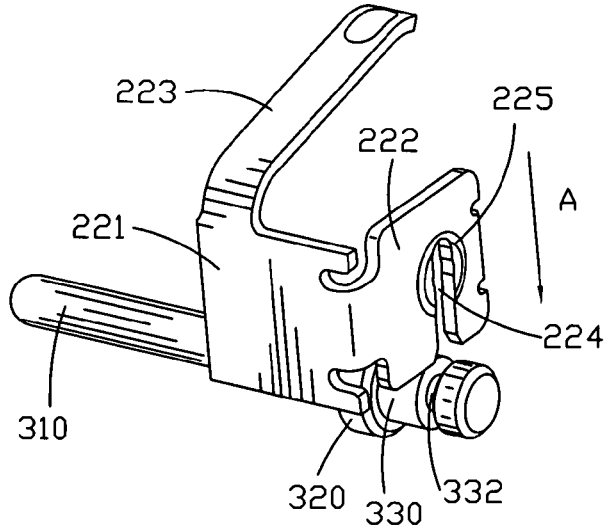
FIG. 6 shows the center pin being going to be assembled with the mating contact.
Figure 7:
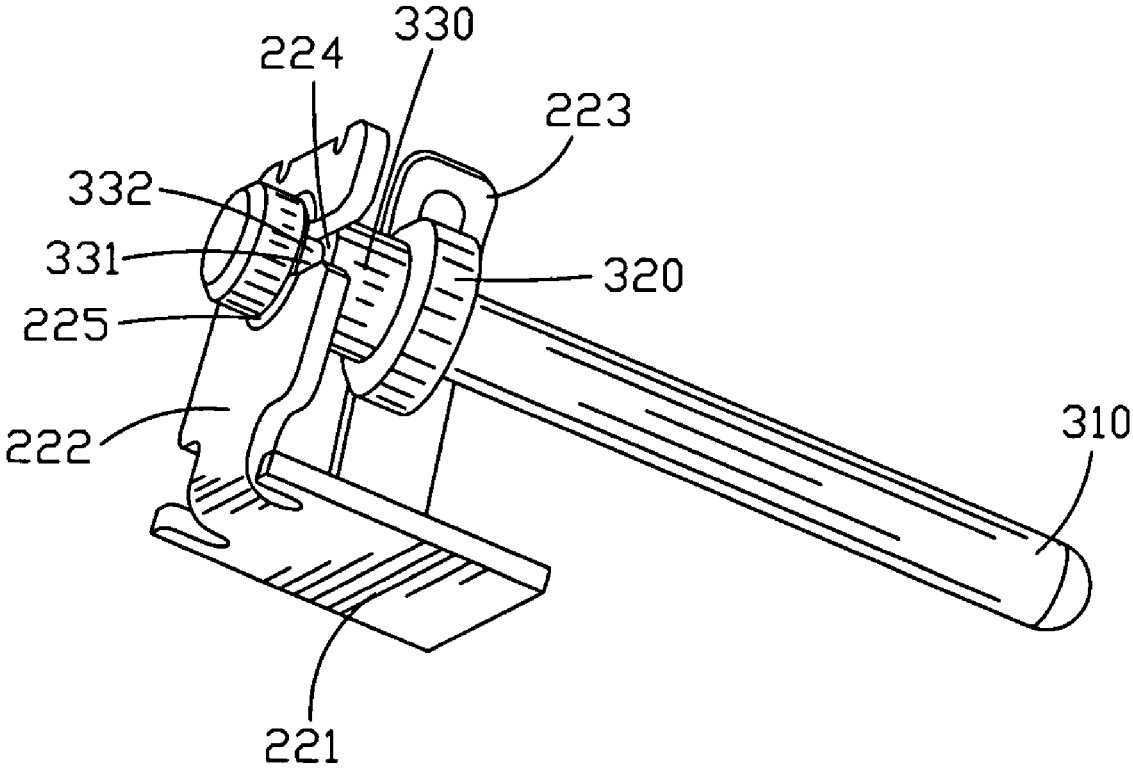
FIG. 7 is a perspective view of the center pin and the mating contact which are assembled together.

Please refer to FIG. 2, FIG. 5 as well as FIG. 1. The insulating housing 100 which is in substantially rectangular shape and disposed longitudinally has a mating wall 111, a rear wall 112 opposite to the mating wall 111, a top wall 113, a bottom wall 114, a first sidewall 115 and a second sidewall 116. The insulating housing 100 defines an inserting cavity 120 passing through the mating wall 111 and extending toward the inner of the insulating housing 100. The rear wall 112 defines a circular through-hole 117 communicating with the inserting cavity 120 and the outside. The front of the through-hole 117 extends outward to define a restraining aperture 118 in the inner of the rear wall 112.

The top wall 113 defines a first contact cavity 131 downward which longitudinally passes through an inner side of the first sidewall 115 and communicates with the inserting cavity 120. The first contact cavity 131 is in the vicinity of the mating wall 111. A mating contact cavity 132 is defined downward from the top wall 113. The mating contact cavity 132 is in L-shape. A longitudinal cavity of the mating contact cavity 132 is defined in the first sidewall 115 and on the same line as the first contact cavity 131. A transverse cavity of the mating contact cavity 132 is defined in the rear wall 112 and is behind the restraining aperture 118. The transverse cavity of the mating contact cavity 132 communicates with the through-hole 117 defined on the rear wall 112. A second contact cavity 133 is defined downward from the top wall 113 and on an inner side of the second sidewall 116. The second contact cavity 133 communicates with the inserting cavity 120 and longitudinally passes through a corresponding side of the rear wall 112.

Figure 3:
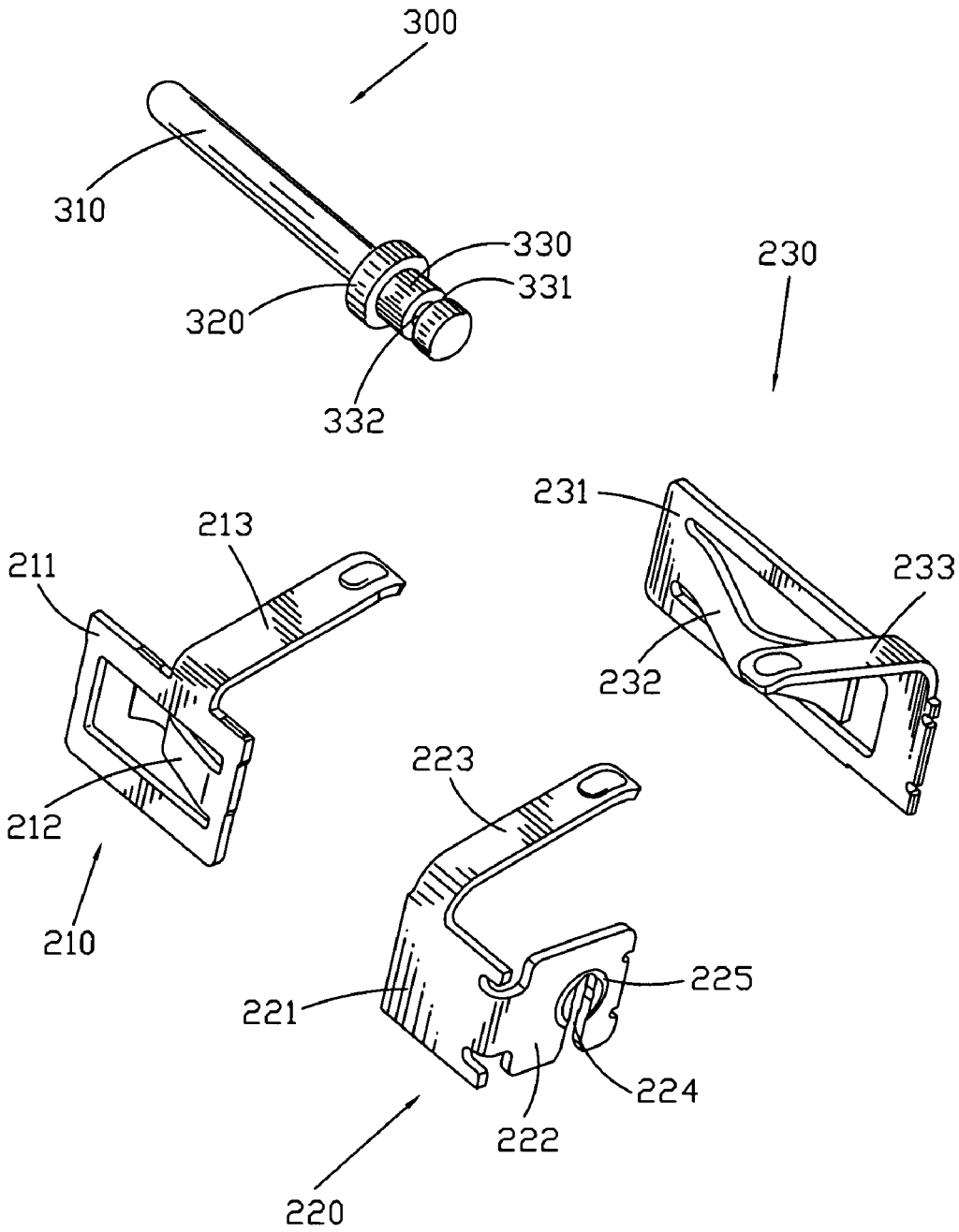
FIG. 3 is a perspective view of contacts as well as a center pin of the audio jack.
Figure 4:
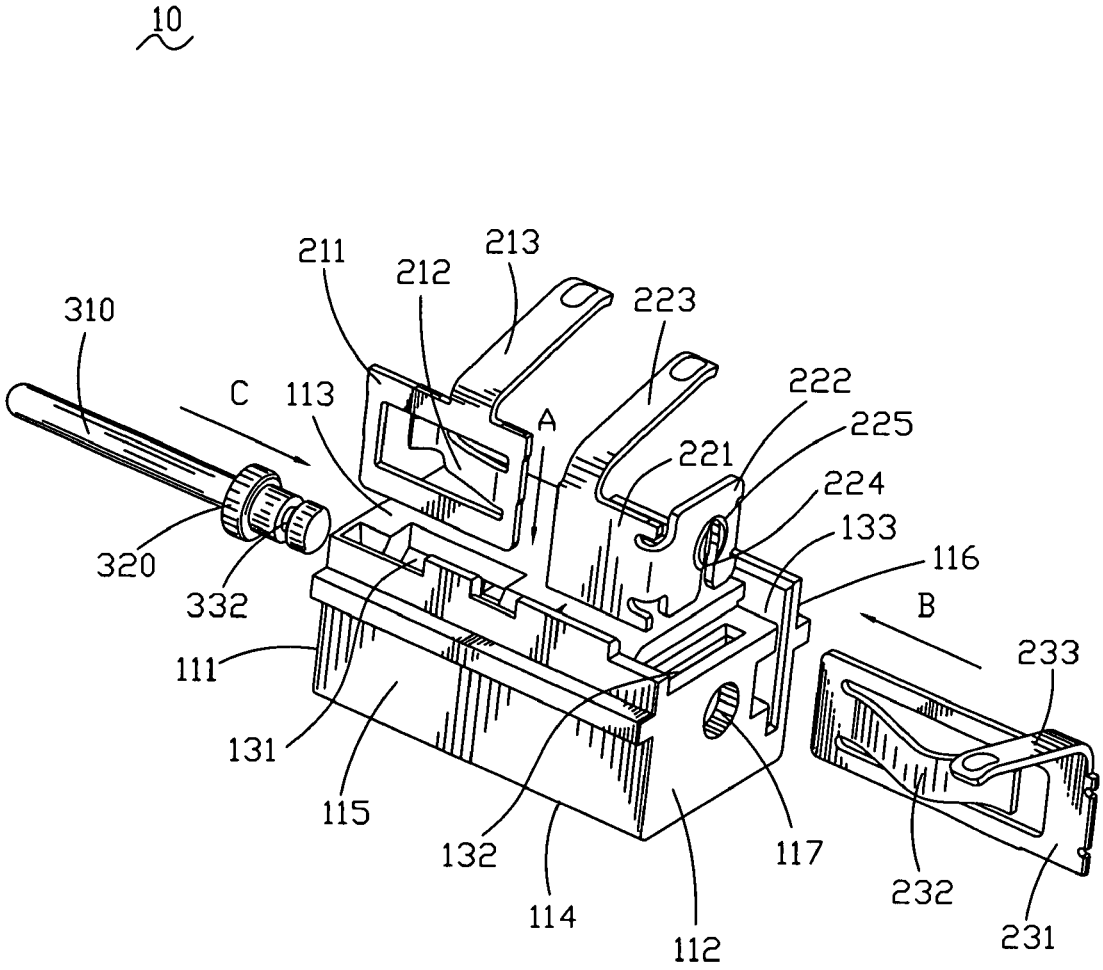
FIG. 4 shows the contacts and the center pin being going to be assembled in the insulating housing.

Please refer to FIG. 3 showing the contacts 200 as well as the center pin 300 of the present invention in detail. The contacts 200 include a first signal contact 210, a second signal contact 230 and a mating contact 220. The first signal contact 210 has a first base portion 211 that is in rectangular hollow sheet-shape. A first resilient portion 212 extends sideward from a rear end of the first base portion 211. A top surface of the first base portion 211 extends toward one side thereof to form a first solder tab 213.

The second signal contact 230 has a similar structure to the first signal contact 210. The second signal contact 230 has a second base portion 231 that is in rectangular hollow sheet-shape. A second resilient portion 232 extends sideward from a front end of the second base portion 231. The rear of a top surface of the second base portion 231 extends toward one side thereof to form a second solder tab 233.

The mating contact 220 has a third base portion 221 in sheet-shape. A rear end of the third base portion 221 perpendicularly bends and extends toward one side thereof to form a secure portion 222. The secure portion 222 defines a reversed U-shaped locating gap 224 thereon passing through the bottom of the secure portion 222. A protrusion 225 that is constituted of two substantial semicircles is disposed around the locating gap 224. The transverse breadths of the protrusion 225 and the locating gap 224 are equal to a diameter of the through-hole 117 defined on the insulating housing 100. The front of a top surface of the third base portion 221 extends toward one side thereof to form a third solder tab 223. The three solder tabs 213, 223, 233 are disposed on a printed circuit board of an electronic device in which the audio jack 10 is mounted (not shown).

The center pin 300 has a long cylindrical connecting portion 310. A rear end of the connecting portion 310 extends rearward to form a cylindrical engaging portion 330. The diameter of the engaging portion 330 is greater than the diameter of the connecting portion 310. The engaging portion 330 defines a clipping groove 331 therearound. The clipping groove 331 surrounds a positioning portion 332 at center. A circular limiting portion 320 projects outward at the junction of the connecting portion 310 and the engaging portion 330. The distance between a front surface of the limiting portion 320 and a rear surface of the engaging portion 330 is substantially equal to the thickness of the rear wall 112 of the insulating housing 100. The width of the clipping groove 331 is substantially equal to the thickness of the secure portion 222 and the protrusion 225 of the mating contact 220. The diameter of the positioning portion 332 is substantially equal to the width of the locating gap 224 defined on the secure portion 222 of the mating contact 220.

With reference to FIGS. 4-7, in assembly, the center pin 300 is mounted in the insulating housing 100 longitudinally along a direction designated C. The connecting portion 310 is received in the inserting cavity 120. The limiting portion 320 is located in the restraining aperture 118. The engaging portion 330 is accommodated in the through-hole 117. The first contact 210 and the second contact 230 are inserted in the insulating housing 100 respectively along directions designated A and B. The first base portion 211 is received in the first contact cavity 131 and the first resilient portion 212 projects into the inserting cavity 120. The second base portion 231 is received in the second contact cavity 133 and the second resilient portion 232 projects into the inserting cavity 120. The first solder tab 213 and the second solder tab 233 are exposed out of the insulating housing 100 and above the top wall 113. The mating contact 220 is inserted in the insulating housing 100 along the direction A. The third base portion 221 and the secure portion 222 are located in the longitudinal cavity and the transverse cavity of the mating contact cavity 132 respectively. The locating gap 224 engages with the positioning portion 332 of the engaging portion 330 of the center pin 300. A part of the protrusion 225 is received in the clipping groove 331 and the rest part of the protrusion 225 is revealed of the clipping groove 331 and is seen from the through-hole 117 of the insulating housing 100. The third solder tab 223 is exposed out of the insulating housing 100 and above the top wall 113.

It can be seen from the preceding description that after the center pin 300 is fabricated in the insulating housing 100, the mating contact 220 is pressed downward. Then the locating gap 224 of the mating contact 220 engages with the positioning portion 332 of the engaging portion 330. Therefore, the center pin 300 is fixedly assembled with the mating contact 220 without utilizing other tools, simplifying the working procedure, and simultaneously, prolonging the using life of the audio jack 10 and securing the electrical interconnection with the mating audio connector. Further more, because the protrusion 225 is seen from the through-hole 117, it is easy to examine whether the mating contact 220 engages with the center pin 300 fully or not, ensuring the quality of the audio jack 10.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An audio jack, comprising:

an insulating housing, having a mating wall, a rear wall opposite to the mating wall, a top wall and two sidewalls, an inserting cavity defined to pass through the mating wall and extend toward the inner of the insulating housing, the rear wall defining a through-hole passing therethough and communicating with the inserting cavity and the outside, the sidewalls defining contact cavities, and a mating contact cavity defined on the rear wall and communicating with the through-hole;

a center pin, having a connecting portion received in the inserting cavity, an end of the connecting portion extending to form an engaging portion accommodated in the through-hole, the engaging portion defining a clipping groove thereabout, the clipping groove surrounding a positioning portion;

contacts, including signal contacts and a mating contact, the signal contacts inserted in the contact cavities respectively, the mating contact having a secure portion received in the mating contact cavity defined on the rear wall of the insulating housing, the secure portion defining a locating gap thereon passing through the bottom thereof, the locating gap engaging with the positioning portion of the center pin;

wherein the secure portion forms a protrusion disposed around the locating gap, a part of the protrusion is received in the clipping groove of the center pin and the remaining part of the protrusion is exposed out of the clipping groove and visible from the through-hole of the insulating housing.

2. The audio jack as claimed in claim 1, wherein the front of the through-hole extends outward to define a restraining aperture in the inner of the rear wall, the junction of the connecting portion and the engaging portion protrudes outward to define a limiting portion which is located in the restraining aperture.

3. The audio jack as claimed in claim 1, wherein the locating gap is in reversed U-shape.

4. The audio jack as claimed in claim 1, wherein the diameter of the engaging portion is greater than the diameter of the connecting portion.

* * * * *